US009125464B2

(12) United States Patent
Minn et al.

(10) Patent No.: US 9,125,464 B2
(45) Date of Patent: Sep. 8, 2015

(54) LOW PROFILE WALLET

(71) Applicant: Humn Design LLC, Portland, OR (US)

(72) Inventors: Kenneth Minn, Portland, OR (US); Scott Hussa, Portland, OR (US)

(73) Assignee: HUMAN DESIGN, LLC, Portland, OR (US)

( * ) Notice: Subject to any disclaimer, the term of this patent is extended or adjusted under 35 U.S.C. 154(b) by 36 days.

(21) Appl. No.: 13/801,891

(22) Filed: Mar. 13, 2013

(65) Prior Publication Data

US 2013/0276943 A1 Oct. 24, 2013

Related U.S. Application Data

(60) Provisional application No. 61/635,634, filed on Apr. 19, 2012.

(30) Foreign Application Priority Data

Sep. 25, 2012 (CN) ..... 2012 3 0460775

(51) Int. Cl.

| | |
|---|---|
| ***A45C 1/06*** | (2006.01) |
| *A45C 13/30* | (2006.01) |
| *A45C 11/18* | (2006.01) |

(52) U.S. Cl.

CPC . *A45C 1/06* (2013.01); *A45C 13/30* (2013.01); *A45C 2001/065* (2013.01); *A45C 2011/186* (2013.01)

(58) Field of Classification Search

CPC .. A45C 1/06; A45C 11/182; A45C 2001/065; B42F 7/14; G07D 9/002

USPC ..... 150/131, 132, 137, 147, 149; 24/17 B, 24/3.5, 67.11; 281/19.1, 2, 42; D11/78.1; D19/27; D3/247

See application file for complete search history.

(56) References Cited

U.S. PATENT DOCUMENTS 1,513,383 A * 10/1924 Fleischer ..... 24/3.5
1,761,809 A * 6/1930 Ancla ..... 24/17 R (Continued)

FOREIGN PATENT DOCUMENTS

CA 2472447 A1 12/2005
CN 2648884 10/2004

(Continued)

OTHER PUBLICATIONS

Wintercheck Factory Website: William Wallet; Oct. 2, 2010; http://web.archive.org/web/20101002104327/http://www.wintercheckfactory.com/shop/13-william-wallet.

*Primary Examiner* — Fenn Mathew
*Assistant Examiner* — Cynthia Collado
(74) *Attorney, Agent, or Firm* — Stolowitz Ford Cowger LLP

(57) ABSTRACT

A low profile wallet may comprise a first plate, a second plate, and a substantially flat strap configured to attach around the first plate and the second plate. Different types, colors, patterns, styles, etc. of plates may be interchanged creating multiple different wallet plate combinations. The plates may include openings formed on opposite sides for retaining the strap. The shape of the openings may enable easier attachment and removal of the strap and in one example also may enable a reduction of the overall size of the plates. Separation notches may be formed on elongated upper or lower ends of the plates. The separation notches may have a substantially concave shape and/or may be offset from lateral sides of the plates.

23 Claims, 8 Drawing Sheets

(56) References Cited

U.S. PATENT DOCUMENTS

| | | | | |
|---|---|---|---|---|
| D286,582 | S | 11/1986 | Phelps | |
| 5,077,869 | A | 1/1992 | Haase | |
| 5,115,909 | A * | 5/1992 | Hull et al. | 206/38 |
| 5,275,217 | A * | 1/1994 | Eakin | 150/132 |
| 5,279,019 | A * | 1/1994 | Knickle | 24/17 B |
| D384,499 | S | 10/1997 | Gaestel | |
| 5,713,406 | A * | 2/1998 | Drury | 150/132 |
| 5,944,080 | A * | 8/1999 | Podwika | 150/147 |
| 6,230,878 | B1 * | 5/2001 | Lehr | 206/37 |
| 7,000,291 | B2 | 2/2006 | Fuller | |
| D590,151 | S | 4/2009 | Karobkina | |
| 7,601,921 | B2 * | 10/2009 | Schroader | 174/372 |
| 7,640,632 | B2 | 1/2010 | Lazarus | |
| D613,293 | S | 4/2010 | Sheba | |
| D627,786 | S | 11/2010 | Hsia | |
| D628,796 | S | 12/2010 | Uzelac | |
| D630,848 | S | 1/2011 | Long | |
| 7,971,324 | B2 | 7/2011 | Preston-Hall | |
| D718,525 | S * | 12/2014 | Kim | D3/247 |
| 2003/0038043 | A1 | 2/2003 | Painsith | |
| 2006/0187055 | A1 | 8/2006 | Colby | |
| 2007/0109130 | A1 | 5/2007 | Edenfield | |
| 2007/0256279 | A1 | 11/2007 | Glickfield | |
| 2007/0289775 | A1 | 12/2007 | Potts | |
| 2010/0230018 | A1 | 9/2010 | Nielsen | |

FOREIGN PATENT DOCUMENTS

| | | |
|---|---|---|
| CN | 201536722 | 8/2010 |
| GB | 128510 | 6/1919 |
| KR | 20070072050 | 7/2007 |
| RO | 121314 | 3/2007 |
| WO | 2010097342 | 9/2010 |

* cited by examiner

LOW PROFILE WALLET

The present application claims priority to U.S. Provisional Patent Application, Ser. No. 61/635,634, entitled: LOW PROFILE WALLET, filed Apr. 19, 2012, which is hereby incorporated by reference in its entirety. The present patent application also claims priority to Chinese Patent Application Ser. No. 201230460775.9 filed, Entitled: Wallet, filed Sep. 25, 2012 which is hereby incorporated by reference in its entirety.

BACKGROUND

Conventional leather wallets are bulky and comprise multiple folded over layers of leather or canvas. The thickness of the wallet, in combination with the cards and money contained within the wallet, create a thick and bulky container for personal items. Conventional wallets also have a tendency to wear out and absorb water.

Hackers may use wireless Radio Frequency Identification (RFID) readers to unlawfully extract personal information from credit cards. The leather or organic materials used in conventional wallets typically do not provide RFID blocking and allow RFID hackers to access information from the credit cards contained within the wallets.

Known metal wallets can retain personal items such as credit cards and money within a relatively low profile and may provide RFID blocking. However, known metal wallets may not securely retain personal items, may be too heavy, lack aesthetic appeal, and may be difficult to operate.

DETAILED DESCRIPTION

Figure 1:
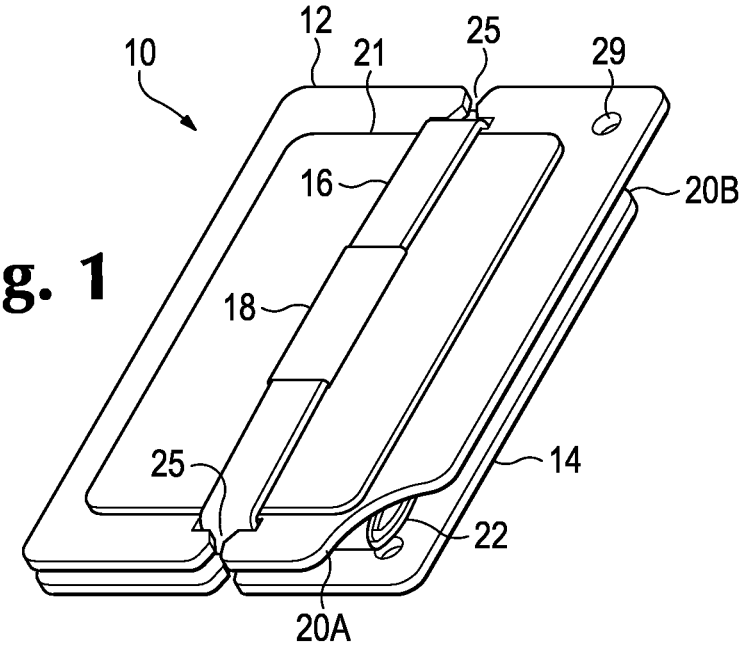
FIG. 1 is a perspective view of a low profile wallet.

Referring to FIGS. 1-4, a low profile wallet 10 comprises two metal and/or carbon fiber plates 12 and 14 held together with an elastic strap 16. Personal items, such as paper money 22, credit cards 24, driver's license, identification cards, membership cards, business cards, or the like, or any combination thereof may be compressively held in-between plates 12 and 14 or may be held outside of either plate 12 or 14.

Elastic strap 16 is connected at opposite ends by a relatively flat metal, plastic, leather or polyurethane leather clasp 18 and inserts into openings 25 formed in opposite ends of plates 12 and 14. Strap 16 may have a relatively flat elongated rectangular cross-sectional shape and an elongated rectangular top profile. The flat wide profile of strap 16 and clasp 18 applies a more stable, even, and distributed compressive force against front and back sides of plates 12 and 14, respectively.

Strap 16 may hold the personal items, such as money 22 and/or credit cards 24 more securely in-between plates 12 and 14 and also may more securely retain the personal items against the front side of plate 12 or against the back side of plate 14. Openings 25 more easily attach to strap 16 and more easily detach from strap 16 while at the same time more securely holding plates 12 and 14 in co-alignment.

The easy detachment of strap 16 from openings 25 promotes easy combination of different plates 12 and 14. For example, the user may attach a first plate 12 having a crimson color with a second plate 14 having a grey color. The user may quickly remove strap 16 from plates 12 and 14 by sliding a first end of strap 16 up and out of the upper openings 25 and sliding a second end of strap 16 down and out of the lower openings 25. One of the plates such as the crimson colored plate 12 may be replaced with a red or white colored plate 12 or a plate with another pattern.

Any combination of colors or patterns may be applied to plates 12 and 14. For example, plate 12 may include a college logo, a geometric pattern, a floral pattern, etc. The user or a manufacturer may easily replace the plates with plates having other patterns or colors without having to disconnect opposite ends of strap 16.

Figure 3:
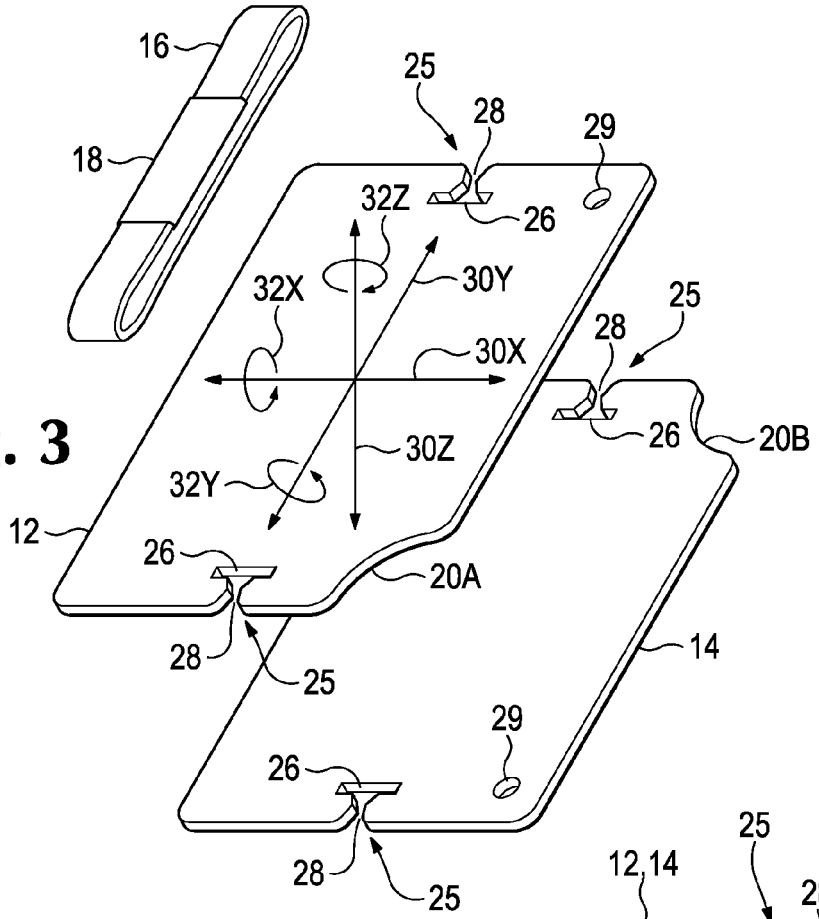
FIG. 3 is an exploded perspective view of the low profile wallet in FIG. 1.
Figure 4:
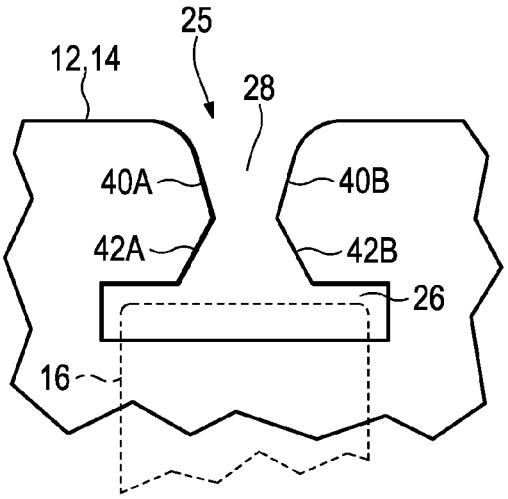
FIG. 4 is a plan view of an attachment opening.

Referring specifically to FIGS. 3 and 4, openings 25 comprise slots 26 having substantially elongated rectangular shapes and notches 28 extending from notches 28 to top and bottom ends of plates 12 and 14. Slots 26 may comprise elongated rectangular shapes with upper and lower walls that extend in parallel with the top and bottom ends of plates 12 and 14. Slots 26 are sized to receive the entire width of elastic strap 16 providing more contact surface area between strap 16 and plates 12 and 14.

Notches 28 may comprise a first set of two oppositely inclining side walls 40A and 40B extending inwardly from top ends of plates 12 or 14 to about half way between the top ends of plates 12 or 14 and slots 26. A second set of two oppositely inclining side walls 42A and 42B may extend outwardly from side walls 40A and 40B, respectively, to slot 26.

A first end of strap 16 may be slid from top ends of plates 12 and 14 through notches 28 in a downward direction toward the center of plates 12 and 14 and seat into upper slots 26. A second end of strap 16 may be slid upward from a bottom end of plates 12 and 14 through lower notches 28 in an upward direct toward the center of plates 12 and 14 and seat into lower slots 26.

Figure 2:
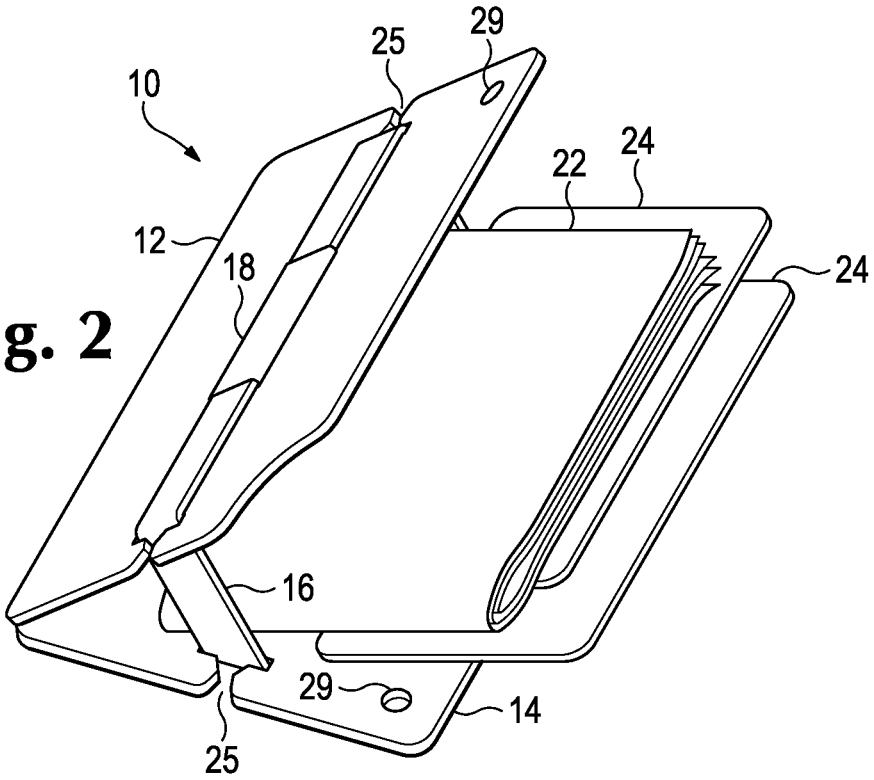
FIG. 2 is a perspective view showing the low profile wallet in an open position.

Openings 25 in combination with strap 16 provide more even distribution of compressive force against plates 12 and 14. For example, elongated slots 26 in combination with the flat cross sectional shape of strap 16 provides more resistance to rotational, vertical, and horizontal movements between plates 12 and 14 while at the same time allowing easy separation of plates 12 and 14 on one side as shown in FIG. 2.

To explain further, plates 12 and 14 may have an x-axis 30*x*, a y-axis 30*y*, and a z-axis axis 30*z*. A user or the materials held within plates 12 and 14 may apply forces that tend to twist plate 12 in a direction 32*x* about x-axis 30X, twist plate 12 in a direction 32*y* about y-axis 30*y*, and/or twist plate 12 in a direction 32*z* about z-axis 30*z*.

In one example, while spreading apart plates 12 and 14, the user may apply a force that tends to twist plate 12 in direction 32*z* about z-axis 30*z*. The lateral sides of slots 26 may press against lateral sides of strap 16 preventing rotation of plate 12 in direction 32*z* about z-axis 30*z* with respect to plate 14.

In another example, materials located between plates 12 and 14 may have uneven thicknesses, such as a larger thickness at a top end of plates 12 and 14 than at a bottom end of plates 12 and 14. The unevenness of the materials may direct compressive force in direction 32*x* about x-axis 30*x* and/or in direction 32*y* about y-axis 30*y*. The elongated width of strap 16 may provide additional resistance preventing some of the rotation or tilting of plate 12 in direction 32*x* and/or direction 32*y*.

The distributed force of strap 16 still enables a user to easily rotate plate 12 about one side of plate 14 as shown in FIG. 2. For example, the user may more readily overcome the compressive force of strap 16 holding plates 12 and 14 together by levering a left side of plate 12 against plate 14 as shown in FIG. 2.

Strap 16 in combination with openings 25 also may reduce sliding of plate 12 with respect to plate 14 in x-axis directions and/or y-axis directions along the plane defined by x-axis 30*x* and y-axis 30*y*. For example, sliding plate 12 upward along y-axis 30*y* with respect to plate 14 causes a bottom end of slot 26 on plate 12 and a top end of a top slot 26 on plate 14 to pinch against bottom and top ends of strap 16, respectively. The pinching condition prevents further upward vertical movement of plate 12 along y-axis 30*y* with respect to plate 14.

Strap 16 in combination with openings 25 also may prevent plate 12 from sliding sideways with respect to plate 14 along x-axis 30*x* in the plane defined by x-axis 30*x* and y-axis 30*y*. For example, sliding plate 12 in a right sideways direction along x-axis 30*x* with respect to plate 14 causes a left lateral side of upper slot 26 on plate 12 and a right lateral side of upper slot 26 on plate 14 to pinch against opposite lateral sides of strap 16. The pinching condition prevents further right sideways movement of plate 12 along x-axis 30*x* with respect to plate 14.

The elongated cross-sectional width of strap 16 applies a wider area of compressive force against personal items 21. The elongated contact area formed between strap 16 and elongated slots 26 also creates upper and lower retention areas that prevent personal items 21, 22, and/or 24 from sliding upwards or downwards along y-axis 30*y*, or sideways along x-axis 30*x* and out of wallet 10.

Thus, the relatively flat elongated shape of strap 16 pressing against plates 12 and 14 may distribute compressive force more evenly and broadly against plates 12 and 14. The distributed compressive force may more securely hold items, such as items 22 and 24 between plates 12 and 14 and/or more securely hold items 21 between against a front face of plate 12 and/or a back face of plate 14. At the same time, strap 16 may also allow a user to relatively easily lever a first side of plate 12 against plate 14 and press apart a second opposite side of plate 12 from a second opposite side of plate 14. For example, the user may separate plates 12 and 14 on one side as shown in FIG. 2 like a clam shell while the opposite sides of plates 12 and 14 remain pressed against each other.

A separation notch 20A is formed on a lower right corner of plate 12 and a similar shaped separation notch 20B is formed on an upper right corner of plate 14. Fingers, such as thumbs, are located within separation notches 20A and 20B and press in opposite directions against the adjacent corners of plates 12 and 14. As shown in FIG. 2, the left side of plate 12 rotates about a front face on the left side of plate 14 separating right sides of plates 12 and 14 and elastically stretching strap 16.

Personal items 22 and 24 are inserted in-between the right sides of plates 12 and 14 and pressure is removed from the lower right corner of plate 14 and the upper right corner of plate 12 adjacent to notches 20A and 20B, respectively. Strap 16 then elastically pulls together the right sides of plates 12 and 14 against opposite sides of personal items 22 and 24 as shown in FIG. 1.

Holes 29 may be formed on the upper right corner of plate 12 and/or on the lower right corner of plate 14 and align with a center of separation notches 20 on adjacent plates 12 or 14. Holes 29 may be used for attaching a key chain, floatation device, or any other attachment apparatus.

Plates 12 and 14 may provide Radio Frequency Identification (RFID) blocking. As explained above, problems currently exist with unauthorized access to personal credit card information. Malfeasance may use RFID technology to wirelessly extract information from credit cards, while the credit cards are located in the wallet of a user.

Wallet 10 may use a metal material for plates 12 and 14, such as aluminum or steel. The metal material may block RFID signals and prevent unauthorized access to the information contained on credit cards 24. In one example, wallet 10 may use an aircraft grade aluminum 6061 with an anodized or powder coat paint finish for plates 12 and 14.

Figure 5:
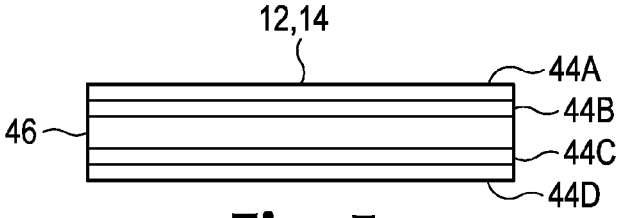
FIG. 5 is a side sectional view of the low profile wallet.

Referring to FIG. 5, wallet 10 also may use carbon fiber sheets 44A-44D for plates 12 and 14. A center metal fabric layer 46 may sandwich in-between carbon fiber sheets 44A-44D to provide anti-RFID blocking. In one example, metal layer 46 may comprise an aluminum foil or any other material that provides shielding against electro-magnetic interference (EMI), radio frequency interference (RFI) microwave, and electro-static discharge (ESD).

In another example, two layers of aluminum foil 46 may sandwich between any two carbon fiber layers 44. In yet another example, aluminum foil layers 46 may sandwich between different carbon fiber layers, such as between carbon fiber layers 44A and 44B, between carbon fiber layers 44B and 44C, and/or between carbon fiber layers 44C and 44D. Carbon fiber plates 12 and 14 may be lighter than metal plates while also providing RFID blocking and/or preventing magnetic waves from erasing or corrupting electronically recorded information on personals items, such as cards 24.

Figure 6:
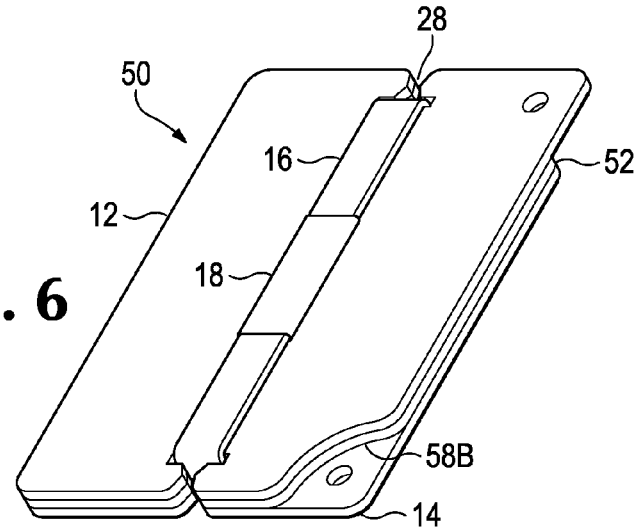
FIG. 6 is a perspective view of the low profile wallet with a divider plate.
Figure 7:
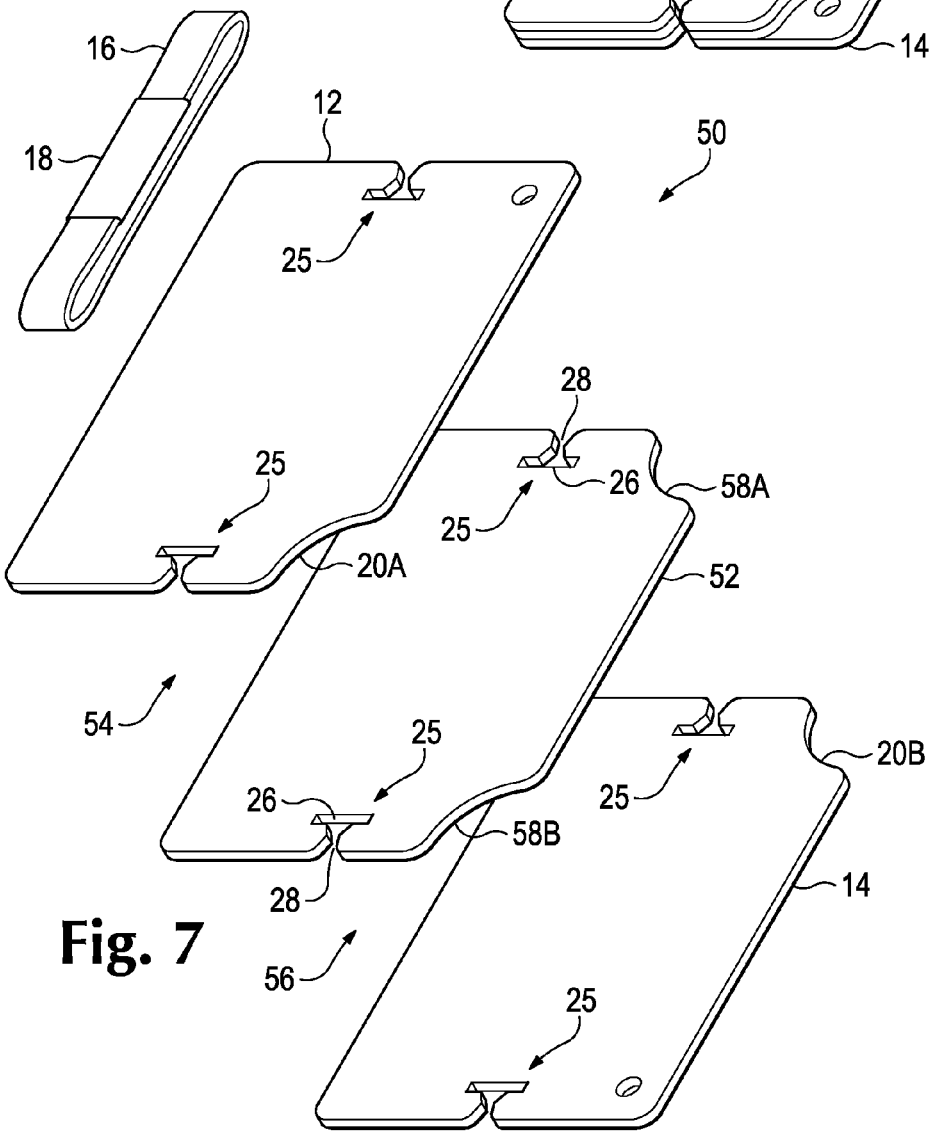
FIG. 7 is an exploded perspective view of the wallet in FIG. 6.

FIG. 6 shows a perspective view of a wallet 50 that includes a divider plate 52. FIG. 7 shows an exploded view of wallet 50 in FIG. 6. Separation notches 58A and 58B are located on an upper right corner and a lower right corner of divider plate 52, respectively. Divider plate 52 may be attached in-between plate 12 and 14 and may include openings 25 similar to openings 25 formed in plates 12 and 14.

Strap 16 may insert through notches 28 into slots 26 of divider plate 52 holding divider plate 52 in-between plate 12 and 14. In one example, the width of divider plate 52 may be slightly narrower than the width of plates 12 and 14. For example, plates 12 and 14 may have a width of approximately 2.94 inches and divider plate 52 may have a width of 2.75 inches. In another example, all three plates 12, 14, and 52 may have the same width of 2.94 inches and a same height of 4.24 inches.

A compartment 54 is formed between plate 12 and divider plate 52 and a compartment 56 is formed between divider plate 52 and plate 14. Different personal items may be inserted into each of compartments 54 and 56. For example, money may be inserted into compartment 54 and credit cards, driver's licenses, etc. may be inserted into compartment 56. Of course, anything may be retained within either compartment 54 or 56.

Figure 8:
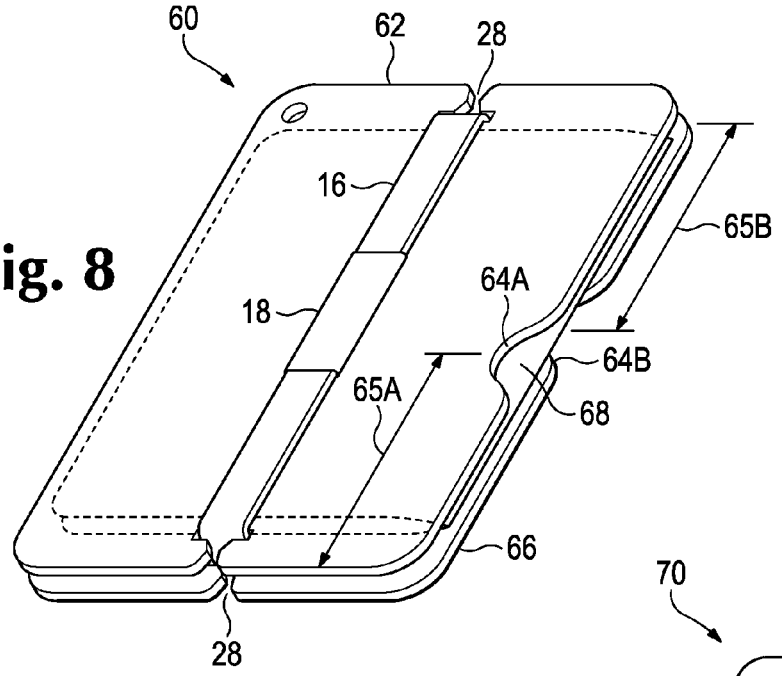
FIG. 8 is a perspective view of a passport wallet.

FIG. 8 shows another example of a low profile passport wallet 60. In this example, plates 62 and 66 may be made from metal or carbon fiber as described above. However, plates 62 and 66 of wallet 60 may be longer and/or wider than plates 12 and 14 for wallet 10 in FIG. 1 for holding a passport 68.

In one example, passport wallet 60 may include separation notches 64A and 64B offset from the center of the right sides of plates 62 and 66. Notch 64A may be located at a distance 65A from a bottom end of plate 62 and notch 64B may be located at a distance 65B from a top end of plate 66. In another example, separation notches 64A and 64B may be located on upper and lower right side corners of plates 62 and 66, respectively, similar to wallet 10 in FIG. 1.

Figure 9:
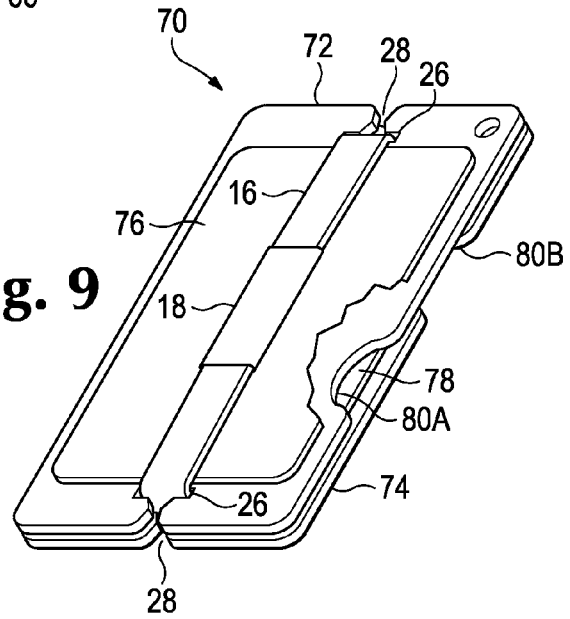
FIG. 9 is a perspective view of a slim-line mini-wallet.

FIG. 9 shows an example of a low profile slim-line mini-wallet 70. In this example, plates 72 and 74 also may use metal or carbon fiber as described above. However, plates 72 and 74 may be shorter and/or narrower than plates 12 and 14 for wallet 10 of FIG. 1 or plates 62 and 66 for wallet 60 in FIG. 8. The shorter height and narrower width of wallet 70 may more easily insert into a wider variety of different locations. For example, slim-line wallet 70 may fit more easily into smaller shallower depth front pant pockets.

Plates 72 and 74 may have a width slightly greater than the width of a conventional credit card. For example, plates 72 and 74 may have a width slightly greater than around 2.125 inches. The spacing between upper and lower slots 26 may be slightly greater than the height of a conventional credit card. For example, a vertical distance between upper and lower slots 26 may be slightly greater than 3.375 inches.

In one example, wallet 70 may include separation notches 80A and 80B on the right side of plates 72 and 74, respectively. Separation notches 80A and 80B may be located at any variety of offsets from the center line of plates 72 and 74, respectively. In one example, notches 80A and 80B may be offset relatively further apart from the center line of plates 72 and 74, respectively, than separation notches 64A and 64B are offset from the center-line of plates 62 and 66, respectively, of wallet 60 in FIG. 8. Any of the positions of separation notches 20, 64, or 80 may be used on any of wallets 10, 60, or 70. Separation notches 20 in FIG. 1, separation notches 64 in FIG. 8 and separation notches 80 in FIG. 9 may be any shape or size, but in one example, are circular, oval, or any other concave shape to more readily receive the thumbs of the user.

Figure 10:
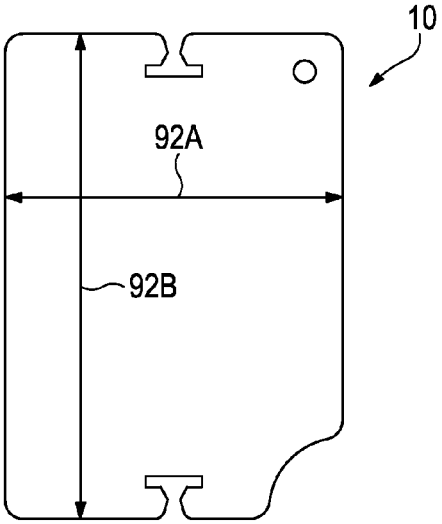
FIG. 10 is a top plan view of the low profile wallet shown in FIG. 1.
Figure 11:
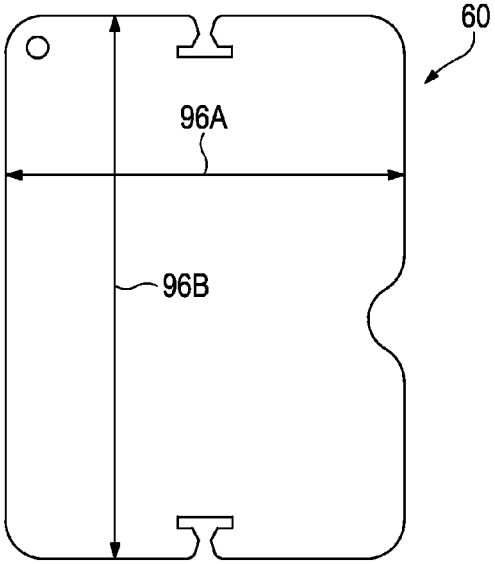
FIG. 11 is a top plan view of the passport wallet shown in FIG. 8.
Figure 12:
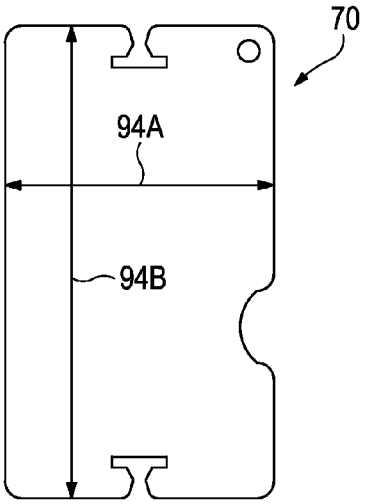
FIG. 12 is a top plan view of the slim-line mini-wallet shown in FIG. 9.

FIGS. 10-12 show comparative relative dimensions of wallets 10, 60, and 70, respectively. In one example, wallet 10 in FIG. 10 may have a width 92A of approximately 2.94 inches and a height 92B of approximately 4.24 inches. In one example, wallet 60 in FIG. 11 may have a width 96A of approximately 3.93 inches and a height 96B of approximately 5.51 inches. In one example, wallet 70 in FIG. 12 may have a width 96A of approximately 2.45 inches and a height 96B of approximately 3.95 inches. Of course, in other examples, any of wallets 10, 60, and 70 may have different dimensions.

Other wallets with different dimensions may be sized for accommodating bank notes, such as British Pounds, Euros, Japanese Yen, or the like or any combination thereof. For example, plates 12 and 14 of wallet 10 may alternatively have a width of approximately of 3.35 inches and a height of approximately 4.24 inches.

Figure 16:
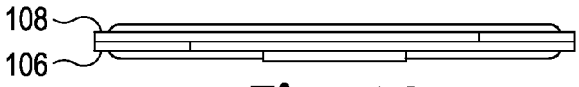
FIG. 16 is a top plan view for the wallet of FIG. 13.
Figures 13, 14, 15:
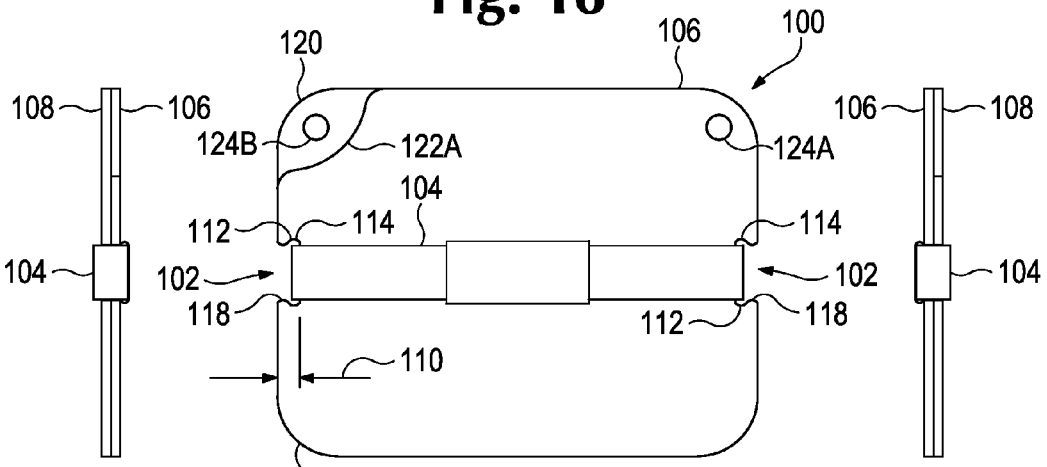
FIG. 13 is a front elevation view of a quick release mini-wallet.
FIG. 14 is a right side elevation view for the wallet of FIG. 13.
FIG. 15 is a left side elevation view for the wallet of FIG. 13.
Figure 17:
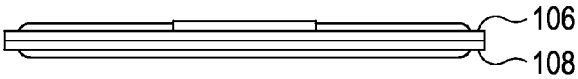
FIG. 17 is a bottom plan view for the wallet of FIG. 13.
Figure 18:
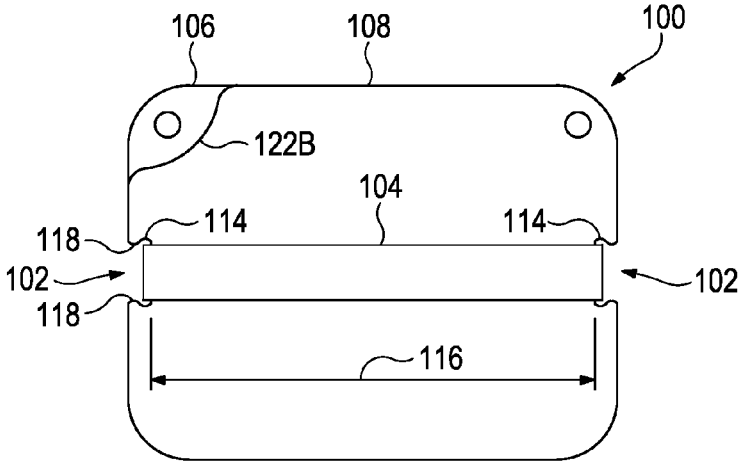
FIG. 18 is a rear elevation view for the wallet of FIG. 13.
Figure 19:
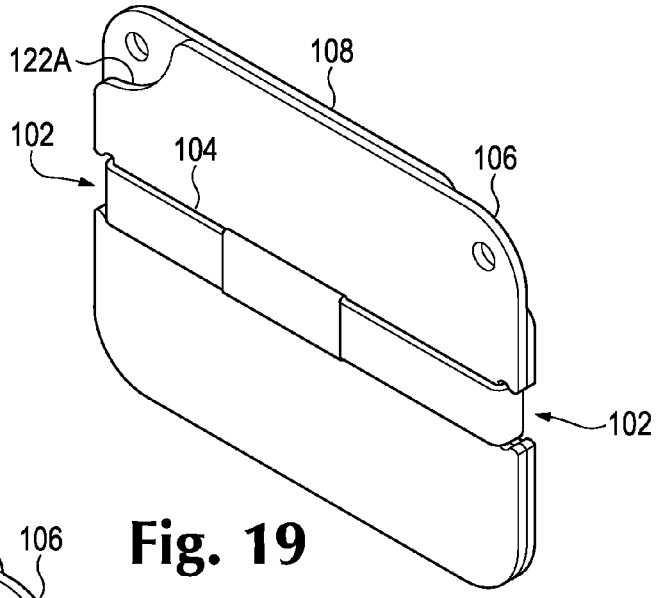
FIG. 19 is a perspective view for the wallet of FIG. 13.
Figure 20:
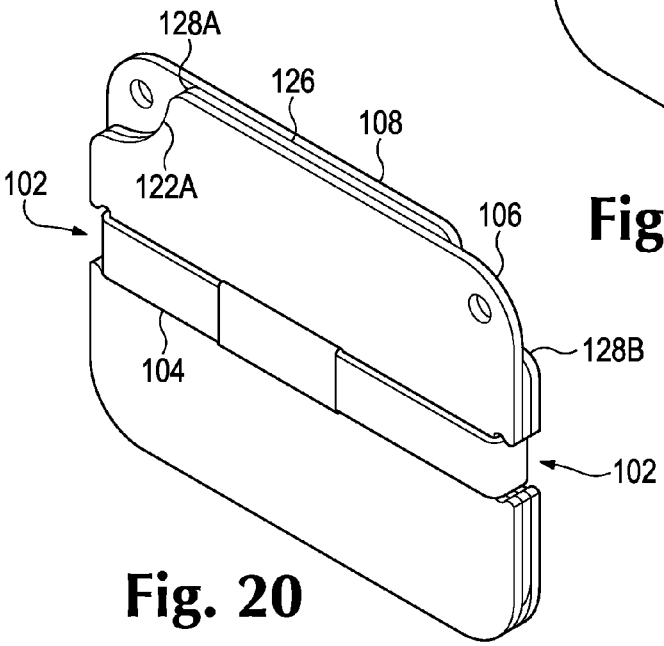
FIG. 20 is a front perspective view for an alternative embodiment of the wallet of FIG. 13 containing a divider plate and having a rear view similar to the front perspective view except without a strap clasp.

FIG. 13 is a front elevation view of a quick release wallet 100. FIG. 14 is a right side elevation view for the wallet of FIG. 13. FIG. 15 is a left side elevation view for the wallet of FIG. 13. FIG. 16 is a top plan view for the wallet of FIG. 13. FIG. 17 is a bottom plan view for the wallet of FIG. 13. FIG. 18 is a rear elevation view for the wallet of FIG. 13. FIG. 19 is a perspective view for the wallet of FIG. 13. FIG. 20 is a front perspective view for an alternative embodiment of the wallet of FIG. 13 containing a divider plate and having a rear view similar to the front perspective view except without a strap clasp.

Referring to FIGS. 13-20, wallet 100 may comprise two plates 106 and 108 that are held together by a strap 104. Low profile openings 102 may be formed in opposite top and bottom ends of plates 106 and 108 for holding strap 104. Low profile openings 102 may have slots 114 and side walls 112 extending from the slots to sides of plates 106 and 108. In one example, side walls 112 form oppositely facing protuberances 118.

Openings 102 may have a shallower depth 110 than the depth of openings 25 in FIG. 1 allowing for a smaller overall size for plates 106 and 108. Distance 116 between ends of slots 114 on the sides of one of plates 106 or 108 may be just longer than the length of a conventional ISO/IEC 7810 identification card. For example, an ID-1 card, such as most banking, driving license, ATM, debit, or ID card may be 85.60 mm×53.98 mm. Distance 116 between ends of slots 114 may be just more than 85.60 mm, such as 88.90 mm.

The shallower depth 110 of openings 102 allow plates 106 and 108 to have a smaller outside diameter and thus take up less room in a pocket of carrying bag. The shallower depth 110 of side walls 112 of openings 102 also allow easier and quicker removal of strap 104 from plates 106 and 108.

In one example, low profile openings 102 may have a depth 110 of around 2.25 mm-4.50 mm. Openings 102 may have a spacing of around 11.70 mm between the protuberances 118 formed by side walls 112 and may have a spacing of around 12.44 mm below the protuberances formed by side walls 112. Protuberances 118 formed on side walls 112 may have a radius of around 1.85 mm and the area on side walls 112 below protuberances 118 may have a radius of around 1.31 mm. Plates 106 and 108 also may have corners 120 with a radius of around 13.87 mm-15.39 mm.

A separation notch 122A may be formed in the upper left corner of plate 106 and a separation notch 122B is formed in an opposite upper right corner of plate 108. In one example, the radius of separation notches 122 may be about the same radius size as corners 120. Holes 124A and 124B may be formed in plates 106 and 108, respectively, and aligned with the center of separation notches 122 formed in the opposing plates.

The shape of corners 120 and/or the shape of openings 102 may be used for any plate size. The low-profile shape of openings 102 may be used on wallet 10 in FIGS. 1-3, wallet 60 in FIG. 8, or wallet 70 in FIG. 9 to reduce the overall width. For example, the low-profile openings 102 may be formed in wallet 10 of FIGS. 1-3 to reduce the width of plates 12 and 14. In one example, the height of plates 12 and 14 in FIGS. 1-3 with low-profile openings 102 may remain the same. Any of wallets 10, 60, and/or 70 also may be formed with corners and/or separation notches similar to the diameters shown for corners 120 and separation notches 122 in FIGS. 13-20.

FIG. 20 depicts an example of a divider plate 126 located between plate 106 and plate 108. Divider plate 126 may include a separation notch 128A having a same shape and aligned with separation notch 122A and a separation notch 128B having a same shape and aligned with separation notch 122B.

Figure 24:
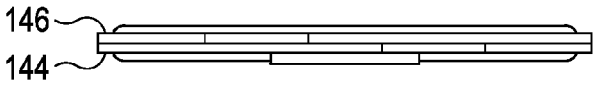
FIG. 24 is a top plan view for the wallet of FIG. 21.
Figure 23:
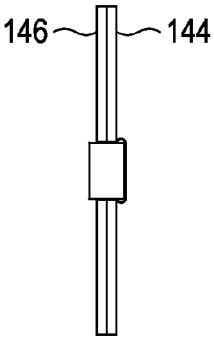
FIG. 23 is a left side elevation view for the wallet of FIG. 21.
Figure 21:
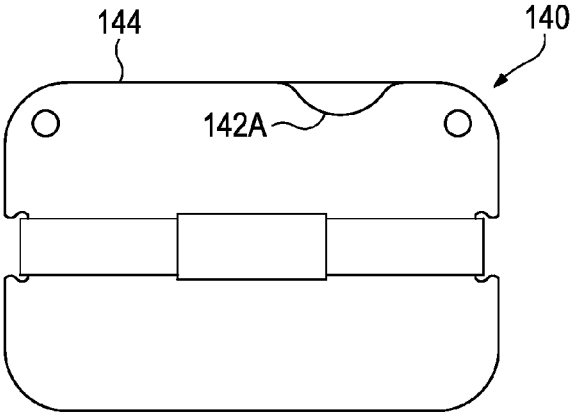
FIG. 21 is a front elevation view for an alternative embodiment of the quick release mini-wallet of FIG. 13 with repositioned separation notches.
Figure 22:
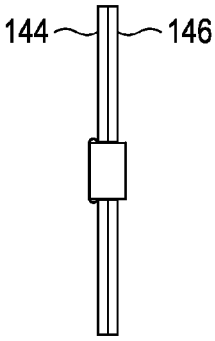
FIG. 22 is a right side elevation view for the wallet of FIG. 21.
Figure 25:
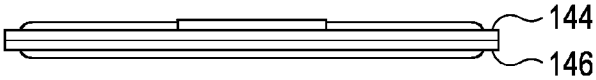
FIG. 25 is a bottom plan view for the wallet of FIG. 21.
Figure 26:
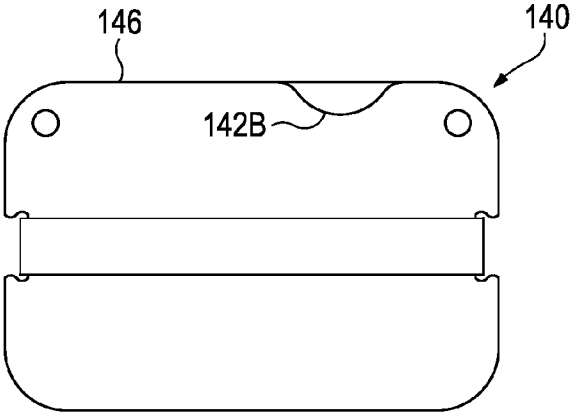
FIG. 26 is a rear elevation view for the wallet of FIG. 21.
Figure 27:
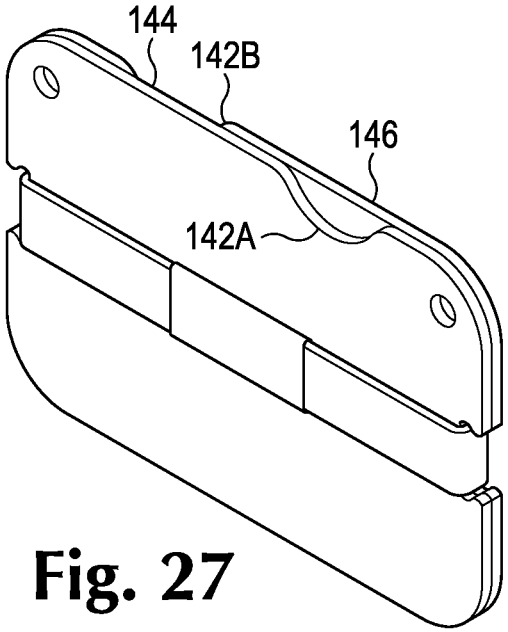
FIG. 27 is a perspective view for the wallet of FIG. 21.
Figure 28:
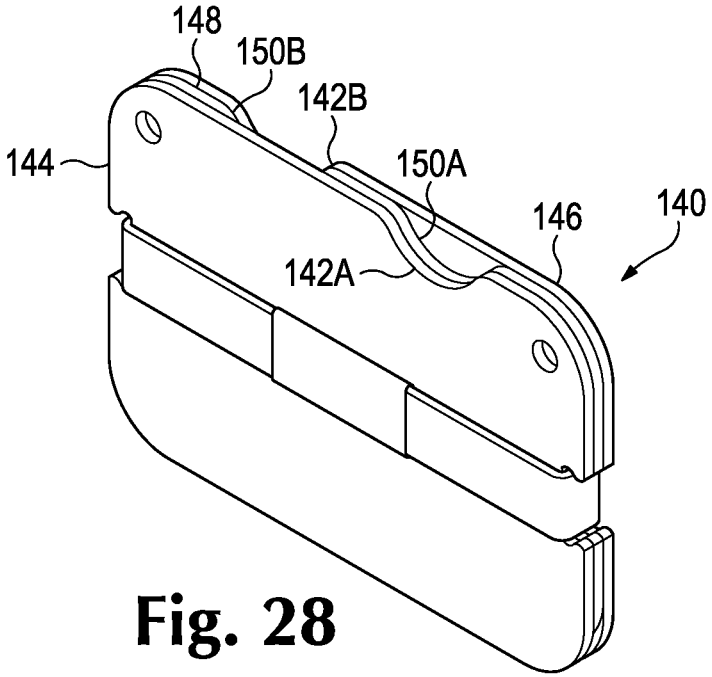
FIG. 28 is a front perspective view for an alternative embodiment of the wallet of FIG. 21 containing a divider plate and having a rear view similar to the front perspective view except without a strap clasp.

FIG. 21 is a front elevation view for an alternative embodiment of a quick release mini-wallet with repositioned separation notches. FIG. 22 is a right side elevation view of the wallet in FIG. 21. FIG. 23 is a left side elevation view of the wallet in FIG. 21. FIG. 24 is a top plan view for the wallet of FIG. 21. FIG. 25 is a bottom plan view for the wallet of FIG. 21. FIG. 26 is a rear elevation view for the wallet of FIG. 21. FIG. 27 is a perspective view for the wallet of FIG. 21. FIG. 28 is a front perspective view for an alternative embodiment of the wallet of FIG. 21 containing a divider plate and having a rear view similar to the front perspective view except without a strap clasp.

Wallet 140 may have substantially a same shape and size as wallet 100 in FIGS. 13-20. However, wallet 140 may have two separation notches 142A and 142A positioned more toward the middle of plates 144 and 146, respectively. For example, separation notch 142A may be located about half way between the right side of plate 144 and a centerline of plate 144. Separation notch 142B may be located about half way between the left side of plate 146 and a center line of plate 146.

In one example, separation notches 142A and 142B may each have a radius of around 5.23 mm. In one example, separation notch 142A may be spaced a distance of around 24.64 mm from the right side of plate 144 and separation notch 142B may be spaced a distance of around 24.64 mm from the left side of plate 146.

FIG. 28 shows another example of wallet 140 with a center separation plate 148. Separation plate 148 may include a first separation notch 150A aligned with separation notch 142A of plate 144. Separation plate 148 may include a second separation notch 150B that aligned with separation notch 142B of plate 146.

References above have been made in detail to preferred embodiment. Examples of the preferred embodiments were illustrated in the referenced drawings. While preferred embodiments where described, it should be understood that this is not intended to limit the invention to one preferred embodiment. To the contrary, it is intended to cover alternatives, modifications, and equivalents as may be included within the spirit and scope of the invention as defined by the appended claims.

Having described and illustrated the principles of the invention in a preferred embodiment thereof, it should be apparent that the invention may be modified in arrangement and detail without departing from such principles. Claim is made to all modifications and variation coming within the spirit and scope of the following claims.

The invention claimed is:

1. A wallet, comprising:

a first plate;

a second plate separate from the first plate, wherein the first plate and the second plate each include top and bottom ends and left and right sides extending between the top and bottom ends, and wherein the left and right sides are longer than the top and bottom ends; and a substantially flat strap configured to attach and detach around the top and bottom ends of the first plate and the second plate and retain materials in-between inner walls of the first plate and the second plate and retain materials against outer walls of the first plate and the second plate, wherein the strap is configured to seat into openings formed in the top and bottom ends of the first and second plates.

2. The wallet of claim 1, further comprising a clasp configured to attach opposite ends of the strap together, wherein the clasp has a substantially flat cross-sectional shape and a rectangular shaped top profile.

3. The wallet of claim 1, further comprising a third plate configured to insert between the first and second plate and attach at opposite top and bottom ends to the strap.

4. The wallet of claim 3, further comprising openings formed in the third plate for receiving the strap, wherein the openings in the third plate align with openings formed in the first plate and the second plate.

5. The wallet of claim 4 wherein each of the openings in the first, second, and third plate each comprise an elongated slot and a notch extending from the slot to the top and bottom ends of the first, second, or third plate, respectively.

6. The wallet of claim 1 wherein the strap is configured to slidingly detach from the first and second plates and slidingly reattach to other plates with different colors or patterns.

7. A wallet, comprising:

a first plate;

a second plate separate from the first plate, wherein the first plate and the second plate each include top and bottom ends and left and right sides extending between the top and bottom ends, and wherein the left and right sides are longer than the top and bottom ends;

a substantially flat strap configured to attach and detach around the top and bottom ends of the first plate and the second plate and retain materials in-between inner walls of the first plate and the second plate and retain materials against outer walls of the first plate and the second plate; and an opening formed in each of the first and second plate, wherein the opening comprises a slot for retaining the strap and a notch extending out from the slot to an edge of one of the top or bottom ends for one of the first and second plate for slidingly receiving the strap for insertion into the slot.

8. The wallet of claim 7, wherein:

the slot comprises an elongated axis extending parallel to the one of the top or bottom ends of the first and second plate; and the notch comprises oppositely facing side walls extending out from lateral ends of the slot to one of the top or bottom ends of the first and second plate.

9. The wallet of claim 7, wherein the notch comprises side walls forming oppositely aligned protuberances extending over opposite lateral ends of the slot.

10. A wallet, comprising:

a first plate;

a second plate separate from the first plate, wherein the first plate and the second plate each include top and bottom ends and left and right sides extending between the top and bottom ends, and wherein the left and right sides are longer than the top and bottom ends;

a substantially flat strap configured to attach and detach around the top and bottom ends of the first plate and the second plate and retain materials in-between inner walls of the first plate and the second plate and retain materials against outer walls of the first plate and the second plate; and separation notches formed on the left and right sides of the first and second plate, respectively.

11. The wallet of claim 10, wherein the separation notches have a substantially concave shape.

12. The wallet of claim 11, wherein a first one of the separation notches is formed in a first corner of the first plate and a second one of the separation notches is formed in a second opposite corner of the second plate.

13. A wallet, comprising:

a first plate;

a second plate separate from the first plate, wherein the first plate and the second plate each include top and bottom ends and left and right sides extending between the top and bottom ends, and wherein the left and right sides are longer than the top and bottom ends;

a substantially flat strap configured to attach and detach around the top and bottom ends of the first plate and the second plate and retain materials in-between inner walls of the first plate and the second plate and retain materials against outer walls of the first plate and the second plate; and a first separation notch located between a middle location of the left side and the top end of the first plate and a second separation notch located between a middle location of the right side and a bottom end of the second plate.

14. A wallet, comprising:

a first plate;

a second plate separate from the first plate, wherein the first plate and the second plate each include top and bottom ends and left and right sides extending between the top and bottom ends, and wherein the left and right sides are longer than the top and bottom ends; and a substantially flat strap configured to attach and detach around the top and bottom ends of the first plate and the second plate and retain materials in-between inner walls of the first plate and the second plate and retain materials against outer walls of the first plate and the second plate, wherein the first and second plate each comprise a first layer of carbon fiber and a second layer of metal fabric.

15. The wallet of claim 14, wherein the first and second plate each comprise a third layer of carbon fiber, wherein the second layer of metal fabric is located in-between the first and third layer of carbon fiber.

16. A wallet apparatus, comprising a plate having a top end, a bottom end, a left side and a right side, wherein the left side and right side are longer than the top and bottom end;

a first opening extending into the top end of the plate for receiving a strap, wherein the first opening has an elongated axis extending parallel with the top end of the plate; and a second opening extending into the bottom end of the plate for receiving the strap, wherein the second opening has an elongated axis extending parallel with the bottom end of the plate.

17. The wallet apparatus of claim 16, further comprising oppositely facing protuberances extending over opposite lateral ends of the first and second opening.

18. The wallet of claim 16, further comprising a separation notch formed on one of the left side or right side of the plate.

19. The wallet of claim 18, wherein the separation notch comprises a substantially concave shape.

20. The wallet of claim 18, wherein the separation notch is positioned between a middle location of the left side or right side of the plate and the top or bottom end of the plate.

21. A wallet, comprising:

a substantially flat plate having a front surface, a back surface, a top end, a bottom end, a left side, and a right side, wherein the left and right side are longer than the top end and bottom end and wherein a center location of the top and bottom end extend inward forming recessed strap receiving sections; and a strap comprising a substantially flat cross-sectional shape configured to extend around the top and bottom end and sit in the strap receiving sections, wherein the strap is further configured to retain materials against the front or back surface of the plate.

22. The wallet of claim 21, further comprising an additional plate having a front surface, a back surface, a top end, a bottom end, a left side, and a right side, wherein the left and right side are longer than the top end and bottom end and wherein a center location of the top and bottom end extend inward forming recessed strap receiving sections, and wherein the strap is configured to sit in the strap receiving sections and hold the plate and the additional plate together.

23. The wallet of claim 21, wherein a distance between the left and right side is configured to be greater than a width of a credit card and a width of paper money.

* * * * *